US007182456B2

(12) United States Patent
Walling

(10) Patent No.: US 7,182,456 B2
(45) Date of Patent: Feb. 27, 2007

(54) HAND-HELD AND HAND-OPERATED DEVICE AND PRINTING METHOD FOR SUCH A DEVICE

(76) Inventor: Alex M. Walling, Messeniusgatan 4. 1 tr., Stockholm (SE) SE-112 57

( * ) Notice: Subject to any disclaimer, the term of this patent is extended or adjusted under 35 U.S.C. 154(b) by 343 days.

(21) Appl. No.: 10/483,531

(22) PCT Filed: Jun. 12, 2002

(86) PCT No.: PCT/SE02/01136

§ 371 (c)(1),
(2), (4) Date: Sep. 8, 2004

(87) PCT Pub. No.: WO03/006249

PCT Pub. Date: Jan. 23, 2003

(65) Prior Publication Data

US 2005/0018033 A1 Jan. 27, 2005

(30) Foreign Application Priority Data

Jul. 13, 2001 (SE) ..... 0102542

Feb. 26, 2002 (SE) ..... 0200564

(51) Int. Cl.
*B41J 3/36* (2006.01)

(52) U.S. Cl. ..... 347/109; 400/88; 400/76

(58) Field of Classification Search ..... 347/109; 400/76, 88

See application file for complete search history.

(56) References Cited

U.S. PATENT DOCUMENTS 5,644,139 A 7/1997 Allen et al.
5,927,872 A 7/1999 Yamada
6,233,368 B1 5/2001 Badyal et al.

*Primary Examiner*—Stephen Meier
*Assistant Examiner*—Ly Tran
(74) *Attorney, Agent, or Firm*—Nixon & Vanderhye P.C.

(57) ABSTRACT

A hand-held and/or hand-operated random movement printing device is controlled by at least one processor. The printing device provides a control to determine the position of an ink-jet print head assembly on a print medium. Specifically the assembly prints a pattern that it uses to determine its position.

16 Claims, 5 Drawing Sheets

HAND-HELD AND HAND-OPERATED DEVICE AND PRINTING METHOD FOR SUCH A DEVICE

This application is the US national phase of international application PCT/SE02/01136 filed in English on 12 Jun. 2002, which designated the US. PCT/SE02/01136 claims priority to SE Application No. 0102542.8 filed 13 Jul. 2001 and SE Application No. 0200564.3 filed 26 Feb. 2002. The entire contents of these applications are incorporated herein by reference.

The present invention pertains to an ink-jet print-head assembly for a hand-held and hand-operated printing on a print medium controlled by a processor, and a method therefore, so called Random Movement Printing Technology (RMPT). It provides a new control to determine the position of the assembly on a print medium. Specifically it prints a pattern that it uses to determine its position.

PRIOR ART

U.S. Pat. No. 5,927,872, A by Yamada shows a hand-held printer having optical sensors, which sensors track positions in real-time of the printer position relative to the surface of a paper. Each optical sensor has an array of optoelectric elements for capturing images of a surface of the paper at fixed time intervals. The optical sensors detect pattern variations on the paper, such as paper fibres, illumination patterns, or graph paper lines. These variations can then be used to determine the position. The hand-held printer might also contain a navigation processor and a printer driver. This is however not a fairly accurate navigation method. Using existing optical sensors to detect variations in a paper structure yields positioning errors between 1 to 2 percent. When printing text on an A4-sized paper, the printer has to be moved back and forth several times resulting in large positioning errors compared to the font size of the text.

In the U.S. Pat. No. 6,233,368 B1 by Badyal et al it is taught a CMOS digital integrated circuit (IC) chip on which an image is captured, digitized, and then processed on-chip in substantially the digital domain.

A preferred embodiment comprises imaging circuitry including a photo cell array for capturing an image and generating a representative analog signal, conversion circuitry including an n-bit successive approximation register (SAR) analog-to-digital converter for converting the analog signal to a corresponding digital signal, filter circuitry including a spatial filter for edge and contrast enhancement of the corresponding image, compression circuitry for reducing the digital signal storage needs, correlation circuitry for processing the digital signal to generate a result surface on which a minima resides representing a best fit image displacement between the captured image and previous images, interpolation circuitry for mapping the result surface into x- and y-coordinates, and an interface with a device using the chip, such as a hand-held scanner.

The filter circuitry, the compression circuitry, the correlation circuitry and the interpolation circuitry are all embodied in an on-chip digital signal processor (DSP). The DSP embodiment allows precise algorithmic processing of the digitized signal with almost infinite hold time, depending on storage capability. The corresponding mathematical computations are thus no longer subject to the vagaries of CMOS chip structure processing analog signals. Parameters may also be programmed into the DSP's software making the chip tunable, as well as flexible and adaptable for different applications.

U.S. Pat. No. 5,644,139 by Allen et al discloses a scanning device and a method for forming a scanned electronic image including the use of navigation information that is acquired along with image data, and then rectifying the image data based upon the navigation and image information. The navigation information is obtained in frames. The differences between consecutive frames are detected and accumulated, and this accumulated displacement value is representative of a position of the scanning device relative to a reference. The image data is then position-tagged using the position data obtained from the accumulated displacement value. To avoid the accumulation of errors, the accumulated displacement value obtained from consecutive frames is updated by comparing a current frame with a much earlier frame stored in memory and using the resulting difference as the displacement from the earlier frame. These larger displacement steps are then accumulated to determine the relative position of the scanning device.

The above documents do only teach how to determine the position in a conceptual generation of navigation information. In this context the U.S. Pat. No. 5,927,872 by Yamada uses the navigation information for a hand-held scanner disclosed in U.S. Pat. No. 5,644,139 by Allen et al. The invention according to Allen et al teaches navigation through comparison of pixels on a frame basis.

Recent technology has provided a piece of paper, which has a virtual raster of a code pattern consisting of a plurality of marks with associated coordinates. The technique that the technology provides makes it possible to write or draw a sketch on the paper, for example, by hand, and to scan the paper with an optical reader, whereby every ink drop of the writing or sketch has its digital position on the paper determined through the code pattern. This makes it possible to scan the paper in a random fashion, and digitally store the writing or sketching obtained from the paper in a computer file. Thus, for example, a signature on a contract can be digitally verified to reassemble the actual signature on a piece of paper with regard to the resolution of the raster coded pattern. Currently the resolution is within hundreds of micrometer (100 μm=0,1 mm).

This raster is accomplished through a gray-scale that is hardly visible for human eyes when placed on a paper appeared to be white in color. The raster pattern also provides a virtual grid of rows and columns to the pattern on a piece of paper. Every mark in a pattern has its own coordinate easily expressed as a binary, hexagonal figure or like, which makes it possible to store an image printed on the paper in a computer file or like.

The revolutionizing technique behind the raster of a code pattern provided piece of paper, and scanners for the same is thoroughly taught through the international applications WO 01/26032, WO 01/26033, and WO 01/26034, all by Pettersson et al.

WO01/26032, WO01/26033 and WO01/26034 show how a piece of paper can be encoded for optical reading and determination of positions on the paper. For example 16 marks (e.g. dots), where each mark is placed in one of four positions, can be used to give an identity of a position. FIG. 3 in WO01/26032 (see also FIG. 6 in this application) illustrates a pattern where 16 marks are placed at a small distance from cross-points in a grid. The marks are placed above, below, to the left or to the right of the cross-points. The marks can be placed at, for example, ⅙ of the distance between two cross-points (in the vertical or horizontal direction). With four possible positions for the marks at each of the 16 cross-points in a pattern group, $4^{16}$ different identities can be indicated by one pattern. Printing patterns indicating unique identities can be used to indicate positions on the paper. The encoding methods described in these documents make an accurate position determination possible. A problem with these methods is that the paper has to be pre-printed with identifiable patterns.

WO01/74598 shows a printer comprising an image sensor for recording an image of a surface and to print on the surface with the aid of the image. The surface contains a position-coding pattern and the printer is adapted to convert the recorded image into a position. The position pattern used is similar to the pattern shown in the, above-mentioned, international applications WO 01/26032, WO 01/26033, and WO 01/26034, by Pettersson et al. A problem with this method is that it is assumed that the printing surface is pre-printed with identifiable patterns. Using an ordinary paper gives that the position determination according to this method fails.

SUMMARY OF THE DISCLOSED INVENTION

A hand-held printer according to the present invention uses a positioning method for printing on a print medium without the drawbacks of the prior art. Specifically the hand-held printer prints a simple navigation pattern and uses the pattern for determining positions on the print medium.

Hence, the present invention sets forth a hand-held and hand-operated random movement printing device controlled by at least one processor controlling comprised means to perform their intended tasks, having an ink-jet print-head assembly comprised in a housing. It further comprises:

an ink container;

a transmitter for transmission of electromagnetic radiation on a print medium;

a receiver for receiving reflected electromagnetic radiation from said print medium;

digital signal processing means providing a digital signal of the inherent information received by reflected radiation;

a memory storing a digitised raster of a code pattern for printing a plurality of marks, each mark being related to a coordinate in an imaginary coordinate system made up of the raster to be printed on said print medium, said memory also storing an image to be printed on the print medium, said image being associated to coordinates in the imaginary coordinate system;

a print-head array disposed to have print nozzles for printing a raster of a code pattern, and for the image to be printed, printing a part of the pattern through spray dozes from the nozzles and related parts belonging to the image; and whereby said raster of a code pattern enables the printer to be randomly moved over a print medium still keeping track of the print-head arrays position, and integrates the image to the coordinate system to be coherently printed.

One embodiment of the present invention provides that the position of the printer, using the coded pattern, is updated only when the position of the image on the print medium does not coincide with marks of the code pattern.

One embodiment of the present invention presents that an image is printed on the print medium by not spraying ink on the positions coinciding with marks of the code pattern, said non-printed positions thus making up a negative raster of a code pattern.

Another embodiment of the present invention provides the at least one ink container separated to accommodate at least a first and a second type of ink and wherein said print-head array is disposed to have a first set of print nozzles for said first type of ink to print said raster of the code pattern and a second set of print nozzles for said second type of ink to print said image.

A further embodiment provides that the raster of a code pattern to be printed on a print medium is printed at least in part on the medium, whereby the image to be printed is printed when the printer re-captures an already printed raster by random movement.

In a further embodiment the printing device uses the microstructure of the print medium to determine its relative movement, and preferably the printing device uses the raster for error correction of the movement determined by using the microstructure of the print medium.

Furthermore, the present invention sets forth a method for a hand-held and hand-operated random movement printing device controlled by at least one processor controlling comprised means to perform their intended tasks. It provides an ink-jet print-head assembly comprised in a housing, at least one ink container, and a memory storing a digitised raster of a code pattern for printing a plurality of marks, each mark being related to a coordinate in an imaginary coordinate system made up of the raster to be printed on a print medium, and also storing an image to be printed on the print medium, said image being associated to coordinates in the imaginary coordinate system. Further comprising the steps of:

transmitting electromagnetic radiation on a print medium through a comprised transmitter;

receiving reflected electromagnetic radiation from said print medium through a comprised receiver;

providing a digital signal of the inherent information received by reflected radiation by comprised digital signal processing means;

printing, through print nozzles in the print-head array, a part of a raster of a code pattern, and printing related parts of the image;

whereby said raster of a code pattern enables the printer to be randomly moved over a print medium still keeping track of the print-head arrays position, and integrates the image to the coordinate system to be printed in a coherent manner.

The method and device according to the invention combines to different ways of optical navigation and could be described as operating on relative coordinates which are provided with a main navigation subsystem using microstructures of the navigation surface and on absolute coordinates provided by said raster of a code pattern. The code pattern thereby correcting possible accumulated errors made by the main navigation subsystem.

The method of the present invention is able to perform method steps of the above assembly embodiments in accordance with attached method sub-claims.

BRIEF DESCRIPTION OF THE DRAWINGS

Henceforth reference is had to the accompanying drawings for a better understanding of the given examples and embodiments of the present invention, wherein.

DETAILED DESCRIPTION OF PREFERRED EMBODIMENTS

The present invention regards a hand-held printer device, which substitutes both the mechanical control of a print-head and forward feeding of a print-out through hand movements on a printing surface. This enables a manufacturing of a printer device, having less width than the actual print-out, and a reduction of the total of mechanical components in its construction.

It is designed to provide a compact portable printing device in order to enable a user to print from small portable devices such as a cellular phone, a portable PC, a personal digital assistance (PDA) or the like, and other portable electronic devices or for electronic stamping, printing of small texts, tags, addresses, cutting and clipping. Equipped with a radio transceiver it can also be used in a wireless LAN for instance.

By fixing a print-head in a construction plate where one or more positioning determining means are fixed as well, it is possible to obtain a geometrical construction with an x- and y-coordinate system and to establish, with great mathematical accuracy, the coordinates x and y for each individual ink-jet opening/nozzle in the print-head or heat print-head. For the sake of simplicity it is only referred to ink-jet printing-heads in the present disclosure, nevertheless excluding other known printing heads.

The coordinates, during a time frame, constitute the grounds for an accurate and precise spraying of ink-drops onto a printing surface according to a predetermined printing design/image. Even when the coordinates change over a time period, it is possible to calculate in real time, the changes in direction, speed, acceleration, rotation etc. along the z-axis controlled by a microprocessor. It provides the possibility to adjust the printing-head to spray an even and pre-programmed flow of ink-jet drops into an adjustable and varying flow of ink-jet drops.

Figure 1:
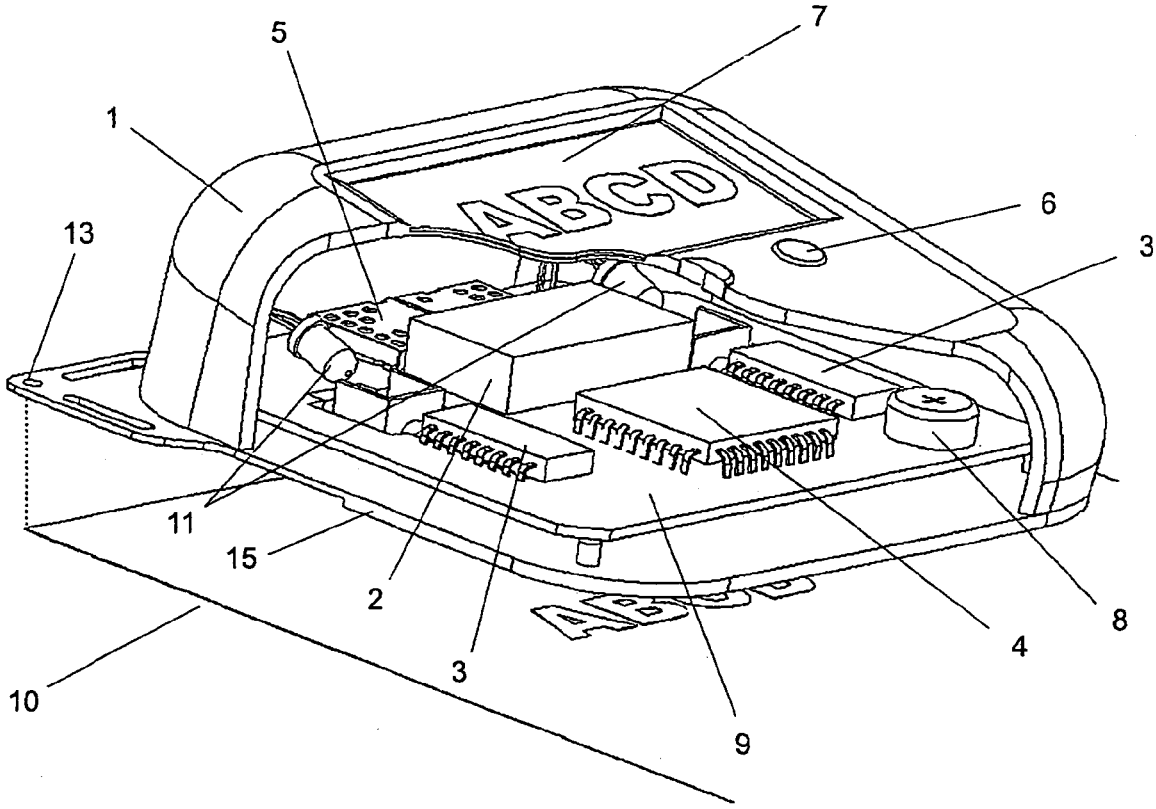
FIG. 1 illustrates a perspective view in section of a printing device according to the present invention.
Figure 2:
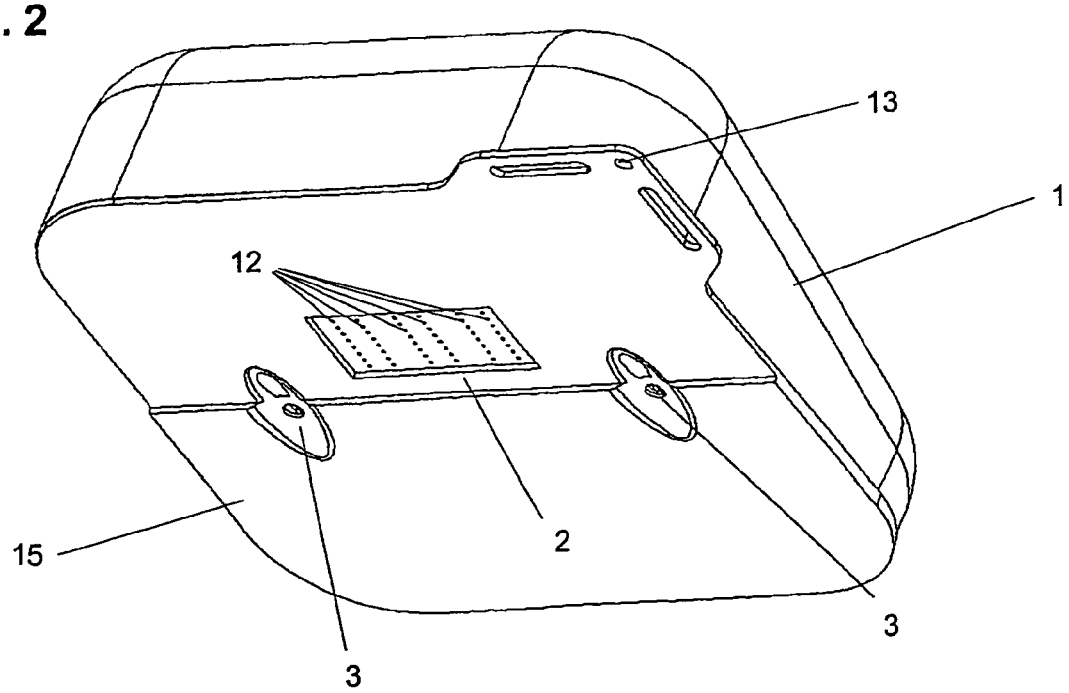
FIG. 2 illustrates a perspective view from underneath of a printing device according to the present invention.

FIGS. 1 and 2 illustrate a hand operated printing device composed by a construction/design body 1 and a print-head 2 which interact with one or more optical positioning transceiver means 3, a micro controller circuit 4, a communication unit 5 to transmit the data, one or more command buttons 6, a control screen 7, and a source of energy, in this case a battery 8.

The embodiment according to FIGS. 1 and 2 illustrate the different components of a printing device fixed to a printed circuit board 9 that simultaneously functions as a construction surface where those components are fixed. An elevation in the construction secures that the lowest surface of the printing device does not touch the area where the ink has been previously applied provided that the printing device is removed from that area.

The printing process starts with a data file containing pre-selected printing patterns, which are sent via the communication unit 5 to a data memory, for example, one which is built into the micro controller circuit 4. With the assistance of a built-in positioning start marking 13 and one of the command buttons 6 the coordinates are indicated to an outgoing point of reference in the printing surface. One or more sources of light, for example light emitting diodes (LED) 11, lighting up the printing frame so that the optical positioning transceiver means are activated and then the forward feeding of the coordinates to the micro controller circuit can take place by using the inherent microstructure of the navigation/printing surface or print medium.

When the positioning sensor means, herein a transceiver (transmitter and receiver) 3 for electromagnetic radiation, and the print-head 2 are fixed in relation to each other, a geometrical construction with all the necessary parameters for a mathematical calculation of the coordinates of the print-head 2 can be achieved.

The micro controller circuit 4 contains a software program, which uses the incoming data from the positioning transceiver means 3 and mathematical equations to calculate in real time the coordinates for each individual ink-jet nozzle 12.

Using the measures of two coordinates establishes the required movement direction for each case. The time difference between two measurements indicates the acceleration and speed required. Simultaneously all measurements and equations are compared with the stored printing commands based upon coordinates equated from the original data file. This is the main system for optical navigation on the print surface.

At this stage the micro controller circuit has sufficient information to seize a decision. On a positive indication an electric impulse is generated in the piezo- or thermo-electrical micro pumps in the concerned ink-jet nozzles 12, which in turn sends out ink-jet drops onto the printing surface 10.

The printing commands are erased after each electric impulse so that even if the ink-jet nozzles coincide with the previous coordinates no ink drops are sent out to the existing print out.

Figure 3:
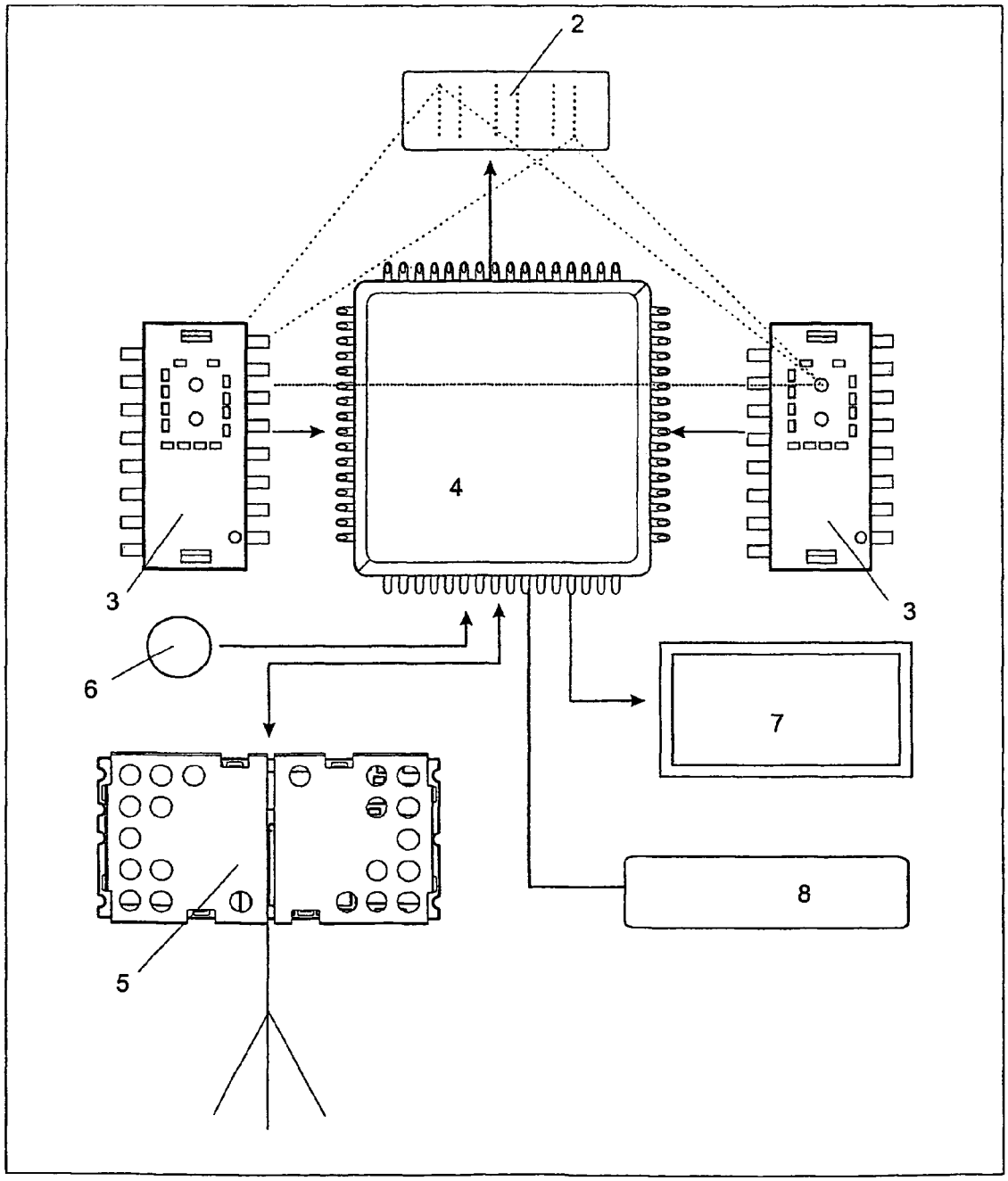
FIG. 3 illustrates a schematic view of the main components of a printing device according to the present invention.

FIG. 3 illustrates how the different components of the printing device interact as well as reproduction of the geometrical forms established between the ink-jet nozzles 12 and the positioning means 3.

Figure 4:
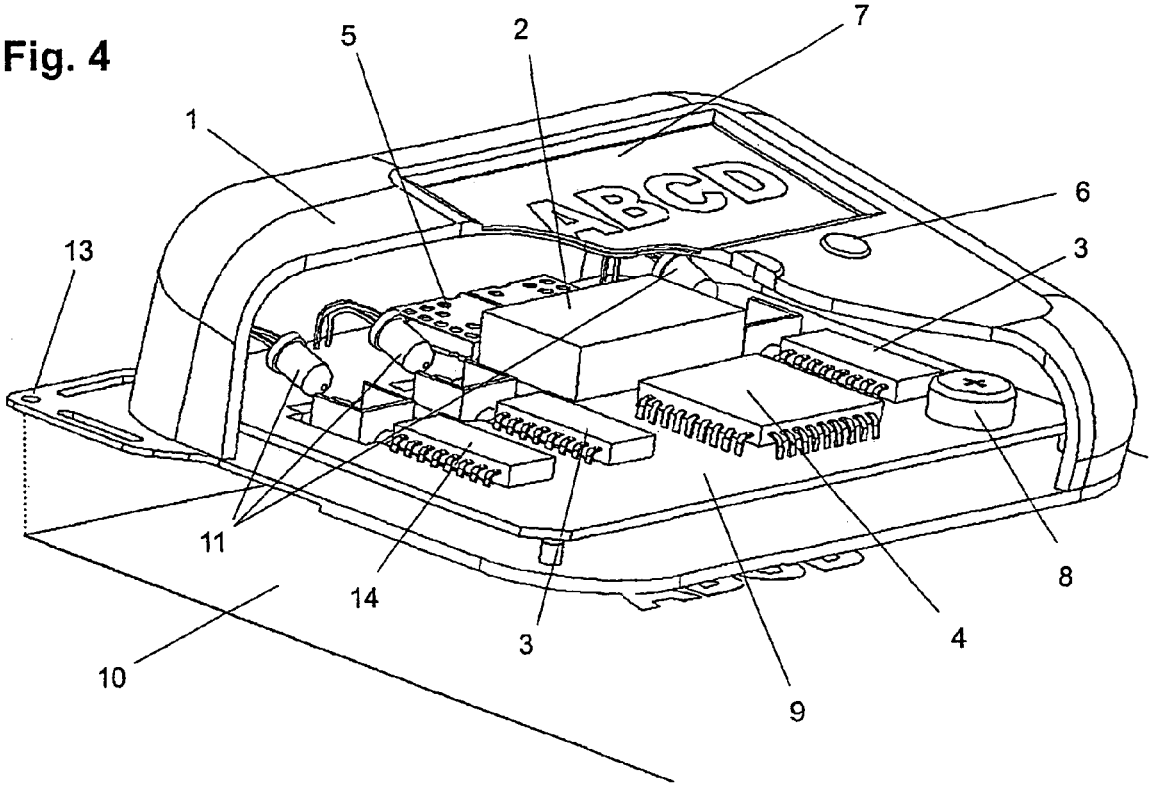
FIG. 4 illustrates a perspective view of another embodiment for a printing device according to the present invention.

The embodiment according to FIG. 4 illustrates the printing device with a complementary digital camera 14, for example, such as a CCD equipped camera According to the invention, an auxiliary system for optical navigation on the print surface is employed. The print-head 2 can be pre-programmed to send out, with even intervals small groups of separated microscopic ink-jet drops, before or during the printing of the actual image, which build a recognizable pattern for the camera 14. The camera registers these dots and transmits the information onto the micro controller circuit 4, which uses the information as a reference for ongoing revision of the position of the printing device. These groups of microscopic ink-drops are essentially invisible to the human eye and they do not affect the printing result in any noticeable way. Those micro-symbols are preferably printed at the same time as the main image and some of them might get covered by parts of it. This could be done practically by merging a bitmap containing the micro-symbols with the main image bitmap.

Figure 6:
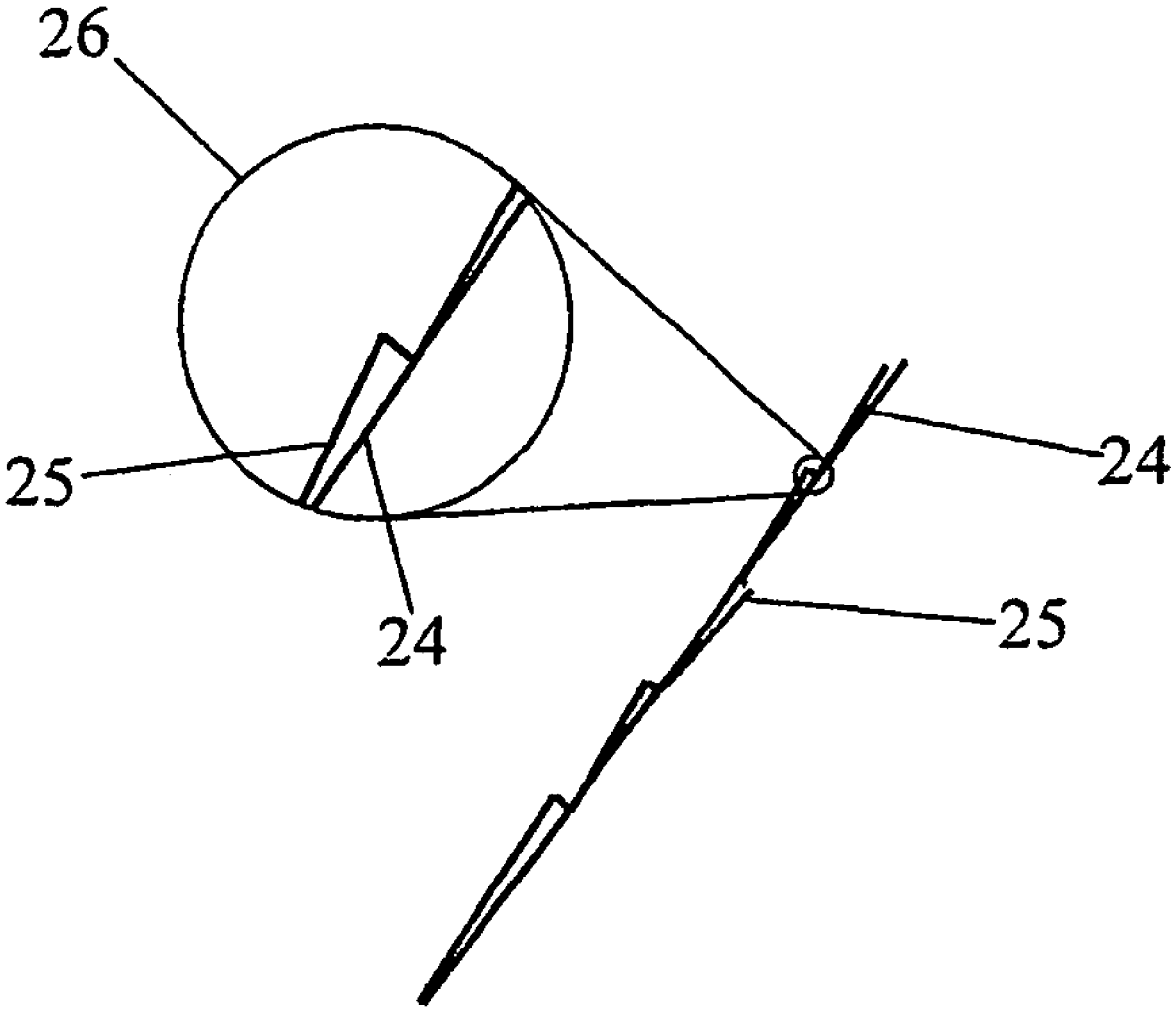
FIG. 6 illustrates the error correction obtained on a print out by implementing present invention.

Using both the mentioned main and auxiliary navigation systems is illustrated in FIG. 6. When intending to print a straight line 24 the errors (highly exaggerated for illustrative purposes in the figure) in the main system using relative coordinates deviates from the line resulting in the printed line 25. As errors add up, this can lead to significant visible errors, especially when printing texts. The auxiliary system can be used to correct this. The blow up 26 of a section of the line 24 shows how the auxiliary navigation system using absolute coordinates corrects the error in the printed line 25 back on track to the intended straight line 24.

The hand-held printing device of the present invention prints a raster of a code pattern on a print medium. It could e.g. use a raster of a code pattern for example in accordance with those taught in the well known prior art of the international applications WO 01/26032, WO 01/26033, and WO 01/26034, all by Pettersson et al or the like known in the art. However, such a code pattern is built up of complex mathematical algorithms, which guarantees that you get a unique code pattern over an immense area. A much simpler pattern which is unique over e.g. a ordinary letter size is preferred. The printed pattern makes up an imaginary coordinate system on the print medium. This coordinate system is then used by the printer to update its position on the print medium, and to print an image on the print medium. The code pattern is briefly described below, but a description of code patterns can also be found elsewhere, for example, a code pattern that can be used is known in the art of digitally determinable print mediums, such as barcodes or 2-D matrix code symbols.

Figure 5:
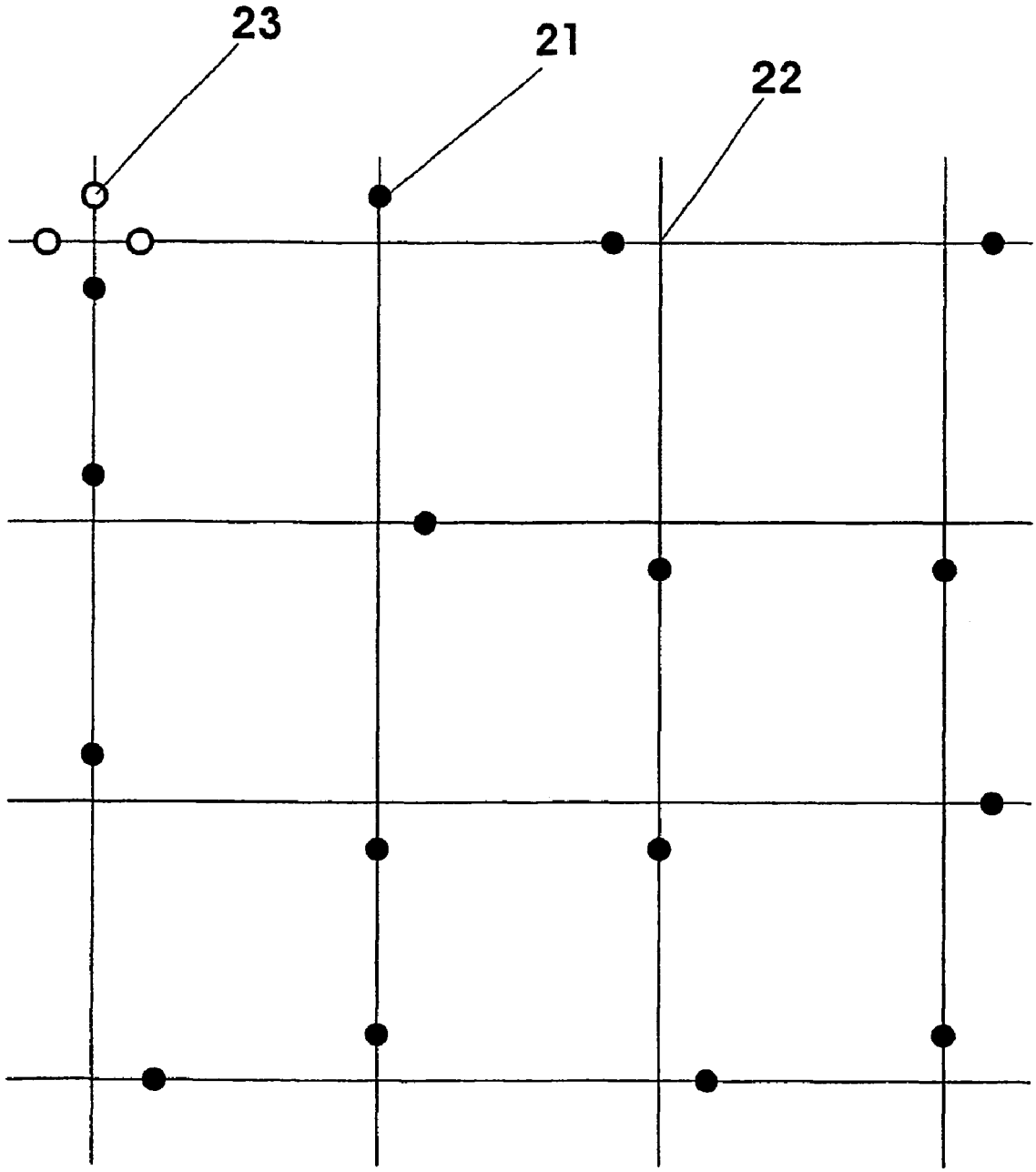
FIG. 5 illustrates marks in raster of a coded pattern similar to prior art.

A part of a raster of a code pattern, similar to prior art code patterns, is illustrated in FIG. 5. There are sixteen dots 21, in the group of dots shown, making up a coordinate. The dots are positioned above, below, to the left or to the right of sixteen grid crossings 22; one dot at each crossing. Three circles 23 show alternative positions for the first dot. Upon printing a raster, the grid is not printed. As said, it is also conceivable within the scope of invention to have a much less complicated code pattern than that described in cited prior art. One could use e.g. a very simple pattern of a few dots grouped together in a certain predefined pattern and having these groups to repeat each other on the paper equally or non-equally distanced covering the surface you want to print on. This simplifies the implementation and uses very limited memory resources since you can limit said pattern to be unique only on a surface as big as e.g. a normal paper and not as in mentioned prior art, i.e. unique on a surface of the size of a continent. The size of each printed mark is preferably approximately the size of the nozzle holes in the print-head.

In an embodiment of the present invention (not illustrated), the hand-held printer has a print-head 2 with two sections. Each section is connected to an ink compartment. The compartments contain two types of ink. One compartment contains an ordinary type of ink for printing objects, such as documents with text and pictures. The other compartment contains a special type of ink for printing the navigation pattern. A micro controller or processor 4 controls the ink jet nozzles heads 12 on both print-head sections. The relative placing of the nozzles to each other is not limited to what is depicted in the figure, but could vary in a number of different patterns. They could e.g. be placed in a single row instead of in a matrix as shown in FIG. 2.

The printer also includes: input means 6, a transmitter 11 for transmission of electromagnetic radiation on a print medium, a receiver 3 for receiving reflected electromagnetic radiation, digital signal processing means, and a memory storing a raster of a code pattern and an image to be printed.

The transmitter, receiver and the special ink are adapted to each other, so that the transmitter transmits a type of electromagnetic radiation for which the ink shows good characteristics, e.g. the ink is highly reflective or highly absorbent for the chosen type of electromagnetic radiation, and the receiver is sensitive to the same radiation. As an example, infrared light can be used.

A digital signal processing means, might be integrated in the receiver and, provides digital signals of the inherent information received by reflected radiation. From these signals the position of the printer is determined using the stored code pattern to identify coordinates.

Prior to printing, a comparison is made between the stored image to be printed and the code pattern and coordinates are applied to the image. When print positions for the code pattern marks and the image coincide the image can be made to leave white spots, i.e. no ink, on these positions. Depending on the chosen ink these print positions can be printed with code pattern marks or be left unprinted and thus make up a partly negative code raster, with the result that the navigation pattern will consist of a combination of microscopic printed dots and unprinted spots in the printed image.

In a more simplified embodiment, the same type of ink and nozzles are used for both the code pattern and the image to be printed. Even if some micro-symbols of the code pattern will partially or totally be hidden by the main image, there will still remain a big quantity of them in free areas. Common printouts have only between 5% coverage for only text up to 15% for text and graphics.

In operation the printer works as follows. As an example a user wishes to print a text on a piece of paper. Text is loaded to the printer by the user, which the printer uses to store image print data in its memory. Navigation code pattern is already stored in the printer. A memory is provided, such as a built-in memory in the micro controller circuit 3. A user positions the printer on the print medium, e.g. an ordinary piece of standard paper, and uses the paper positioning means 13 to position the printer in a start position in the upper left corner of the paper. The user presses the print command button 6 and starts moving the printer across the paper. Thereby the printer immediately starts printing a predetermined navigation pattern using its stored raster of a code pattern, in the form of dots for instance, with the special ink. Provided transmitters, e.g. LED's, 11 starts emitting infra red light onto the paper and at least one receiver, e.g. digital cameras, 14 start recording images. Captured images is used by the micro controller circuit 3 to identify a navigation pattern to determine the position coordinates. The micro controller circuit continuously determines the relative movement of the printer, using the microstructure of the print medium. With this information it determines the positions of every individual ink jet nozzle. Hence the printer continues to print the navigation pattern and prints the pattern at closely spaced regular intervals so that, in a preferred embodiment, the digital camera always has previously printed dots in sight when new dots are added. Every image should preferably include at least one code pattern. In this way the printer is able to determine its position with a high accuracy during the whole printing process. As soon as the printer reaches a position where the text is to begin it starts printing. In the preferred embodiment, the printer is set to update its position by using the auxiliary navigation subsystem only when actually finding a code pattern. That implies that no absolute position calibration takes place when the code pattern cannot be found, e.g. when parts of the printed image covers the pattern. Consequently, the printer uses relative positioning to determine its movement and calibrates its position information to coordinates in the raster, when actually finding a pattern.

Alternatively, the printer can be set to print a navigation raster of a code pattern first, and thus providing a print medium with a coordinate raster. An image, e.g. a document with text and pictures, can then be printed later when the printer is moved across the print medium and re-captures the already printed raster.

In a preferred embodiment the micro controller circuit registers the printed pattern dots and printed image parts and continuously updates the print data so that the printer never prints on the same position twice even if the printer is moved to a previously printed position.

Preferably, the printer searches among previously printed coordinate patterns when determining its position. This can be obtained by storing the code pattern in a table form, and creating a smaller lookup table that includes only the previously printed code patterns. This smaller lookup table is then used when identifying the code patterns. The printer can also be programmed to start the search among code patterns that is likely to be found close to its current position.

Note that when using a predefined dot pattern with a virtual grid, as for example in WO01/26034, the digital cameras will capture images, of the printed navigation pattern; these images will be used to determine information about the position. This position information is then used when continuing printing the navigation pattern. Since in the raster of the code pattern the distance between the dots are exactly defined the position is determined very accurately.

The prior art documents discussed above (WO01/26032, WO01/26033 and WO01/26034) uses, for example, overlapping patterns. A man skilled in the art might use overlapping patterns, but can of course use non-overlapping patterns, for example the individual pattern groups can be distinguished by being spaced apart or the "beginning" of every pattern can be indicated by an "illegal" mark, like two marks for the upper left corner.

Alternatively, a bubble jet print head could be used or any other suitable print head.

It is appreciated that the means used in the present invention are hardware means or software means or a combination of both.

The present invention is not restricted to given embodiments or examples, but the attached set of claims define other embodiments for a person skilled in the art.

The invention claimed is:

1. A hand-held and hand-operated random movement printing device controlled by at least one processor (4), controlling comprised means to perform their intended tasks, having an ink-jet print-head (2) assembly comprised in a housing (1), further comprising:

at least one ink container;

a transmitter for transmission of electromagnetic radiation on a print medium;

a receiver for receiving reflected electromagnetic radiation from said print medium;

digital signal processing means providing a digital signal of the inherent information received by reflected radiation;

a memory storing a digitised raster of a code pattern for printing a plurality of marks, each mark being related to a coordinate in an imaginary coordinate system made up of the raster to be printed on said print medium, said memory also storing an image to be printed on the print medium, said image being associated to coordinates in the imaginary coordinate system;

a print-head array disposed to have nozzles for printing a raster of a code pattern, and print nozzles for the image to be printed, printing a part of the pattern through spray dozes from the nozzles and related parts belonging to the image; and whereby said raster of a code pattern enables the printer to be randomly moved over a print medium still keeping track of the print-head arrays position, and integrates the image to the coordinate system to be coherently printed.

2. A printing device according to claim 1, wherein an image is printed on the print medium by preventing the print-head to spray ink on the positions coinciding with marks of the code pattern, said non-printed positions thus making up a negative raster of a code pattern.

3. A printing device according to claim 1, wherein the position of the printer using the coded pattern is updated only when the position of the image on the print medium does not coincide with marks of the code pattern.

4. A printing device according to claim 1, wherein said at least one ink container is separated to accommodate at least a first and a second type of ink and wherein said print-head array is disposed to have a first set of print nozzles for said first type of ink to print said raster of the code pattern and a second set of print nozzles for said second type of ink to print said image.

5. A printing device according to claim 4, wherein an image is printed on the print medium by preventing the print-head to spray ink on positions coinciding with marks of the code pattern, thereby enabling said marks to be identified by the receiver due to its different reflection/absorption characteristics.

6. A printing device according to claim 1, wherein the raster of a code pattern to be printed on a print medium is printed at least in part on the medium before the image is printed, whereby the image to be printed is printed when the printer re-captures an already printed raster by random movement.

7. A printing device according to claim 1, wherein the printing device uses the microstructure of the print medium to determine its relative movement.

8. A printing device according to claim 7, wherein the printing device uses the raster for error correction of the movement determined by using the microstructure of the print medium.

9. A method for a hand-held and hand-operated random movement printing device controlled by at least one processor (4) controlling comprised means to perform their intended tasks, having an ink-jet print-head (2) assembly comprised in a housing (1), at least one ink container, and a memory storing a digitised raster of a code pattern for printing a plurality of marks, each mark being related to a coordinate in an imaginary coordinate system made up of the raster to be printed on a print medium, and also storing an image to be printed on the print medium, said image being associated to coordinates in the imaginary coordinate system, comprising the steps of:

transmitting electromagnetic radiation on a print medium through a comprised transmitter;

receiving reflected electromagnetic radiation from said print medium through a comprised receiver;

providing a digital signal of the inherent information received by reflected radiation by comprised digital signal processing means;

printing, through print nozzles in the print-head array, a part of a raster of a code pattern, and printing related parts of the image;

whereby said raster of a code pattern enables the printer to be randomly moved over a print medium still keeping track of the print-head arrays position, and integrates the image to the coordinate system to be printed in a coherent manner.

10. A method according to claim 9 wherein an image is printed on the print medium by preventing the print-head to spray ink on the positions coinciding with marks of the code pattern, said non-printed positions thus making up a negative raster of a code pattern.

11. A method according to claim 9 wherein the position of the printer using the coded pattern is updated only when the position of the image on the print medium does not coincide with marks of the code pattern.

12. A method according to claim 9 wherein said at least one ink container used accommodates at least a first and a second type of ink separated, said raster of the code pattern is printed through a first set of print nozzles disposed in said print-head using a first type of ink, and said image is printed through a second set of print nozzles disposed in said print-head using a second type of ink.

13. A method according to claim 12 wherein an image is printed on the print medium by preventing the print-head to spray ink on positions coinciding with marks of the code pattern, thereby enabling said marks to be identified by the receiver due to its different reflection/absorption characteristics.

14. A method according to claim 9 wherein the raster of a code pattern to be printed on the print medium is printed at least in part on the medium, whereby the image to be printed is printed when the printer re-captures an already printed raster by random movement.

15. A method according to claim 9, wherein the microstructure of the print medium is used to determine the relative movement of the printing device.

16. A method according to claim 15, wherein the raster is used for error correction of the movement determined by using the microstructure of the print medium.

* * * * *